US007095384B2

(12) United States Patent
Koreyasu et al.

(10) Patent No.: US 7,095,384 B2
(45) Date of Patent: Aug. 22, 2006

(54) ARRAY ANTENNA

(75) Inventors: Misa Koreyasu, Nishinomiya (JP); Tetsuya Takashima, Nishinomiya (JP); Katsufumi Hiraoka, Nishinomiya (JP); Akihiro Hino, Nishinomiya (JP)

(73) Assignee: Furuno Electric Company Limited, Nishinomiya (JP)

( * ) Notice: Subject to any disclaimer, the term of this patent is extended or adjusted under 35 U.S.C. 154(b) by 0 days.

(21) Appl. No.: 11/134,286

(22) Filed: May 23, 2005

(65) Prior Publication Data

US 2005/0259028 A1 Nov. 24, 2005

(30) Foreign Application Priority Data

May 24, 2004 (JP) ..... 2004-153591

(51) Int. Cl.
*H01Q 21/00* (2006.01)
*H01Q 1/38* (2006.01)

(52) U.S. Cl. ..... 343/853; 343/700 MS; 343/770

(58) Field of Classification Search ..... 343/853, 343/700 MS
See application file for complete search history.

(56) References Cited

U.S. PATENT DOCUMENTS 4,912,481 A * 3/1990 Mace et al. ..... 343/700 MS
5,790,078 A * 8/1998 Suzuki et al. ..... 343/700 MS
6,002,370 A 12/1999 Mckinnon et al.
6,806,845 B1 * 10/2004 Fund et al. ..... 343/853
2005/0099358 A1 * 5/2005 McCarrick ..... 343/853
2005/0219140 A1 * 10/2005 Browne et al. ..... 343/814
2006/0055604 A1 * 3/2006 Koenig ..... 343/700 MS

FOREIGN PATENT DOCUMENTS

JP 11-312909 11/1999

* cited by examiner

*Primary Examiner*—Trinh Vo Dinh
(74) *Attorney, Agent, or Firm*—Birch, Stewart, Kolasch & Birch, LLP

(57) ABSTRACT

Antenna elements are arranged in line on a surface of a substrate at specific intervals along a longitudinal direction of the substrate. A phase-inverting distributor is formed on the surface of the substrate in an area located between two antenna elements which are closest to and located on both sides of a vertical centerline, or a reference line, of the substrate. A primary feeder line formed along the longitudinal direction of the substrate extends from the phase-inverting distributor on both left and right sides thereof. The individual antenna elements are connected to the primary feeder line by secondary feeder lines having predetermined impedances. The secondary feeder lines are connected to the respective antenna elements on sides thereof which are perpendicular to the longitudinal direction of the substrate and face the reference line on which the phase-inverting distributor is located.

6 Claims, 6 Drawing Sheets

Prior Art

ARRAY ANTENNA

BACKGROUND OF THE INVENTION

1. Field of the Invention

The present invention relates to an array antenna on which a plurality of antenna elements for radiating radio waves are arranged generally in line, forming a linear array.

2. Description of the Related Art

There exist various kinds of conventionally known array antennas employing a configuration in which a plurality of antenna elements are formed on a substrate and the individual antenna elements are connected to secondary feeder lines which are arranged parallel to one another.

FIG. 6 is a plan view generally showing the configuration of a conventional array antenna on which a plurality of antenna elements are arranged generally in line. This kind of conventional array antenna is shown in Japanese Patent Application Publication No. 1999-312909, in which antenna elements are arranged side by side as shown in FIG. 6.

Referring to FIG. 6, the array antenna includes a substrate 1 having a rectangular shape in plan view, multiple antenna elements 2*a*–2*i* formed on a surface of the substrate 1, secondary feeder lines 3*a*–3*i* connected respectively to the antenna elements 2*a*–2*i*, a primary feeder line 4 connected to the individual secondary feeder lines 3*a*–3*i*, and an outgoing line 5 of which one end is connected to the primary feeder line 4 and the other end is connected to an external circuit (not shown). The substrate 1 is made of a dielectric material while the antenna elements 2*a*–2*i*, the secondary feeder lines 3*a*–3*i*, the primary feeder line 4 and the outgoing line 5 are made of a patterned conductor layer formed on the surface of the substrate 1.

More specifically, the antenna elements 2*a*–2*i* are arranged on the substrate 1 generally in line along a longitudinal (horizontal as illustrated in FIG. 6) axis of the substrate 1 at specified equal intervals with long sides of the successive antenna elements 2*a*–2*i* placed side by side. The secondary feeder lines 3*a*–3*i* are connected to the respective antenna elements 2*a*–2*i* on the sides thereof (right sides as illustrated in FIG. 6) which are perpendicular to and face one direction along the longitudinal axis of the substrate 1. This arrangement is used to ensure that the antenna elements 2*a*–2*i* produce electric fields in the same direction and the individual secondary feeder lines 3*a*–3*i* have a specific impedance. The interval between the successive antenna elements 2*a*–2*i* is normally made equal to an integer multiple of the wavelength of radio waves such that the radio waves emitted from the antenna elements 2*a*–2*i* are synchronized in phase and radiation pattern of the array antenna is optimized.

In the aforementioned configuration, all of the antenna elements 2*a*–2*i* are arranged at regular intervals, whereby the array antenna radiates a high-intensity radio wave in a specified direction.

As shown in FIG. 6, the substrate 1 has an overall length $L_{pwb}$ and the array antenna has a substantial antenna length $L_{ant}$. In the aforementioned conventional array antenna, the secondary feeder lines 3*a*–3*i* are connected to the antenna elements 2*a*–2*i* on the sides thereof facing the same direction along the longitudinal axis of the substrate 1. It is therefore impossible to form antenna elements all the way from the proximity of one end of the substrate 1 to the proximity of the other end of the substrate 1 along the longitudinal axis thereof. As a result, the substantial antenna length $L_{ant}$ is shorter than the overall length $L_{pwb}$ of the substrate 1, making it impossible to form the array antenna on the substrate 1 in an efficient fashion.

SUMMARY OF THE INVENTION

In light of the foregoing, it is an object of the invention to provide an array antenna having desired directivity, in which antenna elements can be formed in a specific pattern on a substrate in an efficient way.

According to the invention, an array antenna includes a substrate, a plurality of antenna elements formed on a surface of the substrate in such a way that the antenna elements are arranged generally in a straight line, a plurality of secondary feeder lines individually connected to the antenna elements on sides thereof which are perpendicular to an arraying direction of the antenna elements, a primary feeder line to which the individual secondary feeder lines are connected parallel to one another, and a phase-inverting distributor inserted in the primary feeder line in an area located halfway along the length of the primary feeder line. In this array antenna of the invention, the sides of the antenna elements connected to the individual secondary feeder lines face a reference line which passes through the phase-inverting distributor perpendicular to the arraying direction of the antenna elements, the antenna elements are symmetrically arranged with respect to the reference line, and at least one of element-to-element intervals differs from the others.

In one feature of the invention, the primary feeder line and the secondary feeder lines are symmetrically arranged with respect to the aforementioned reference line. Alternatively, the phase-inverting distributor is located at a point of intersection of the aforementioned reference line and a second reference line passing through midpoints of the sides of the antenna elements which are parallel to the aforementioned reference line, the second reference line being perpendicular to the reference line, and the primary feeder line and the secondary feeder lines are symmetrically arranged with respect to the point of intersection of the reference line and the second reference line.

In the aforementioned configuration of the array antenna, the secondary feeder lines are connected to the respective antenna elements on the sides thereof facing the reference line on which the phase-inverting distributor is formed halfway along a longitudinal direction of the substrate. This means that sides of two antenna elements facing both longitudinal ends of the substrate are not connected to the secondary feeder lines. Thus, the antenna elements can be formed substantially all the way along the longitudinal direction of the substrate, from one longitudinal end thereof to the other. As will be later discussed in detail with reference to preferred embodiments of the invention, signals transmitted to the secondary feeder lines on left and right sides of the substrate are inverted in phase by the phase-inverting distributor. As a result, radio waves radiated from the antenna elements symmetrically arranged on the opposite sides of the reference line are not canceled out one another despite the fact that the secondary feeder lines supplies the signals to the antenna elements on the left and right sides of the substrate from opposite sides.

In the array antenna of the invention, one or more element-to-element intervals differ from the other element-to-element intervals as stated above. This means that the antenna elements can be arranged at desired intervals. This makes it possible to manufacture an array antenna having sharp directivity in a specific direction by properly determining the element-to-element intervals such that a desired radiation pattern (directivity) of the array antenna would be obtained as a result of mutual interference among the radio waves radiated from the individual antenna elements.

In another feature of the invention, conductor lines from the phase-inverting distributor to the individual antenna elements have varying impedances on each side of the reference line, each of the conductor lines including a portion of the primary feeder line and one of the secondary feeder lines.

In this array antenna of the invention, the conductor lines from the phase-inverting distributor to the individual antenna elements have varying impedances on each side of the reference line. This is equivalent to an array antenna configuration in which attenuators having varying amounts of attenuation are inserted in the conductor lines connected to the individual antenna elements. In this configuration, the individual antenna elements emit radio waves at intensities varying from one antenna element to next on each side of the reference line so that desired directivity is obtained as a result of mutual interference among the radio waves radiated from the individual antenna elements.

In still another feature of the invention, the interval between only those two antenna elements which are closest to the phase-inverting distributor differs from the interval between any two adjacent antenna elements.

Since the element-to-element interval differs only at a mid-length position of the substrate where the phase-inverting distributor is located according to this feature of the invention, the array antenna can be produced with a simple configuration by forming the antenna elements in a simplified arrangement pattern.

These and other objects, features and advantages of the invention will become more apparent upon reading the following detailed description in conjunction with the accompanying drawings.

DETAILED DESCRIPTION OF THE PREFERRED EMBODIMENTS OF THE INVENTION

An array antenna according to a first embodiment of the invention is now described with reference to FIGS. 1 to 3 and Tables 1 and 2.

Figure 1:
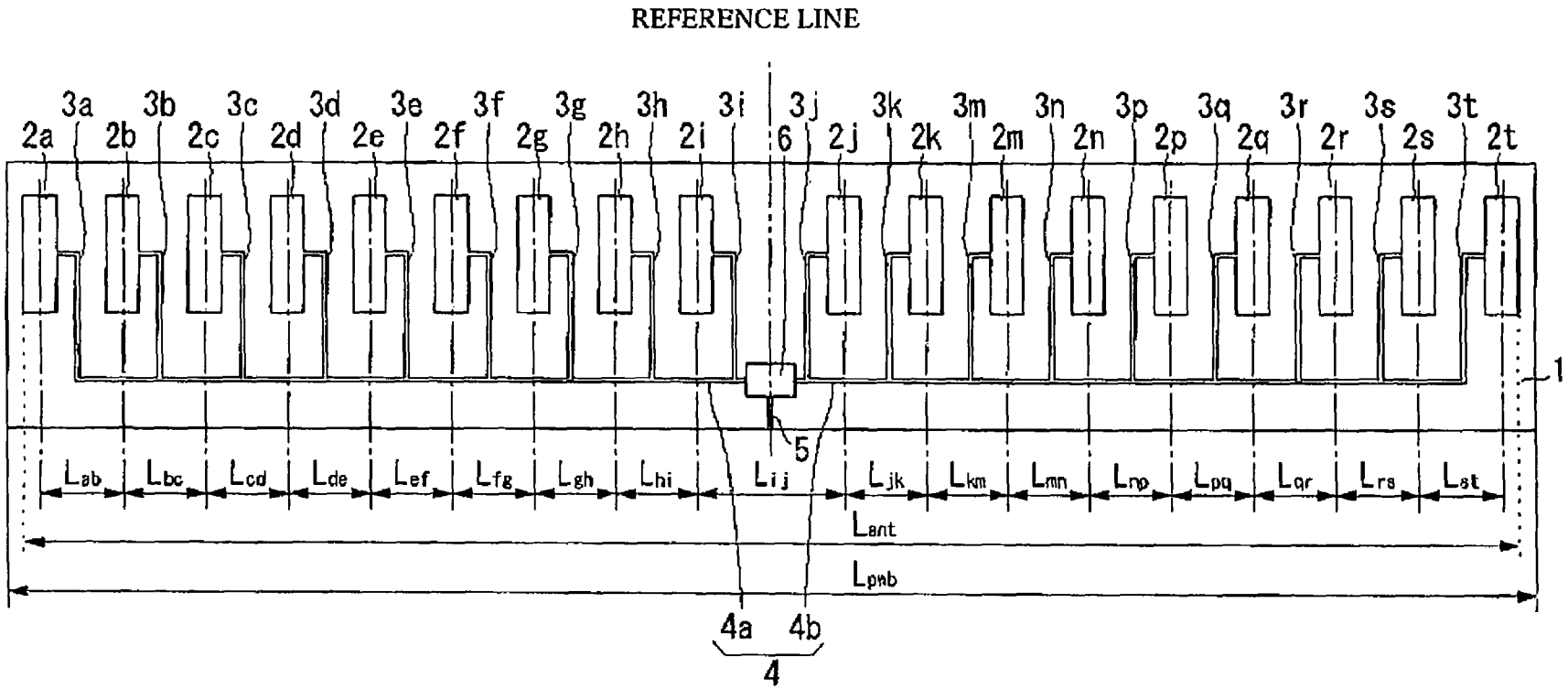
FIG. 1 is a plan view generally showing the configuration of an array antenna according to a first embodiment of the invention.

FIG. 1 is a plan view generally showing the configuration of the array antenna according to the first embodiment of the invention. Referring to FIG. 1, the array antenna includes a substrate 1 having a rectangular shape in plan view and a plurality of antenna elements 2*a*–2*t* formed on a surface of the substrate 1, the antenna elements 2*a*–2*t* being arranged in a predetermined array pattern. The array antenna further includes a plurality of secondary feeder lines 3*a*–3*t*, a primary feeder line 4, an outgoing line 5 and a phase-inverting distributor 6 which are also formed on the surface of the substrate 1. The substrate 1 is made of a dielectric material while the antenna elements 2*a*–2*t*, the secondary feeder lines 3*a*–3*t*, the primary feeder line 4 and the outgoing line 5 are made of a patterned conductor layer (including conductor lines and electrodes) formed on the surface of the substrate 1. The phase-inverting distributor 6 is made of a specific pattern of conductor formed in a joint area between the primary feeder line 4 and the outgoing line 5, the phase-inverting distributor 6 including a signal distribution circuit and a phase-inverting circuit, for example.

The antenna elements 2*a*–2*t* each have a rectangular shape in plan view and are formed in such a fashion that long sides of the antenna elements 2*a*–2*t* are aligned parallel to short sides of the substrate 1 and short sides of the antenna elements 2*a*–2*t* are aligned parallel to long sides of the substrate 1. These antenna elements 2*a*–2*t* formed on the substrate 1 are arranged at specified intervals along a longitudinal direction of the substrate 1 (parallel to the long sides of the substrate 1). The phase-inverting distributor 6 is formed in an area located generally on a vertical centerline, or a "reference line" passing between the antenna element 2*i* and the antenna element 2*j* shown by an alternate long and short dashed line in FIG. 1, the location of the phase-inverting distributor 6 being separated from an area where the antenna elements 2*a*–2*t* are arranged on the substrate 1 by a specific distance in a short side direction of the substrate 1.

The primary feeder line 4 is formed in a linear pattern extending leftward and rightward from the phase-inverting distributor 6 along the longitudinal direction of the substrate 1, that is, the direction in which the antenna elements 2*a*–2*t* are arrayed. Thus, as can be seen from FIG. 1, the primary feeder line 4 includes a first primary feeder line portion 4*a* extending leftward along the antenna elements 2*a*–2*i* and a second primary feeder line portion 4*b* extending rightward along the antenna elements 2*j*–2*t*.

The antenna elements 2*a*–2*i* are connected to the first primary feeder line portion 4*a* by the secondary feeder lines 3*a*–3*i*, respectively. As depicted in FIG. 1, upper ends of these secondary feeder lines 3*a*–3*i* are connected to the respective antenna elements 2*a*–2*i* on the long sides thereof which are perpendicular to the arraying direction of the antenna elements 2*a*–2*i* and face the aforementioned reference line on which the phase-inverting distributor 6 is located. Each of the secondary feeder lines 3*a*–3*i* is generally L-shaped, having a horizontal portion extending for a specific distance along the arraying direction of the antenna elements 2*a*–2*t*, or along the longitudinal direction of the substrate 1, and a vertical portion extending from one end of the horizontal portion perpendicular to the first primary feeder line portion 4*a*, or parallel to the short sides of the substrate 1. The vertical portion of each of the secondary feeder lines 3*a*–3*i* is connected to the first primary feeder line portion 4*a*.

Similarly, the antenna elements 2*j*–2*t* are connected to the second primary feeder line portion 4*b* by the secondary feeder lines 3*j*–3*t*, respectively. As depicted in FIG. 1, upper ends of these secondary feeder lines 3*j*–3*t* are connected to the respective antenna elements 2*j*–2*t* on the long sides thereof which are perpendicular to the arraying direction of the antenna elements 2*j*–2*t* and face the aforementioned reference line on which the phase-inverting distributor 6 is located. Each of the secondary feeder lines 3*j*–3*t* is generally L-shaped, having a horizontal portion extending for the specific distance along the arraying direction of the antenna elements 2$j$–2$t$, or along the longitudinal direction of the substrate 1, and a vertical portion extending from one end of the horizontal portion perpendicular to the second primary feeder line portion 4$b$, or parallel to the short sides of the substrate 1.

The array antenna of the present embodiment thus structured has a bilaterally symmetrical configuration with respect to aforementioned reference line on which the phase-inverting distributor 6 is located, the reference line being perpendicular to the arraying direction of the antenna elements 2$j$–2$t$. More specifically, the array antenna has a pattern of electrodes and conductor lines forming the antenna elements 2$a$–2$i$, the secondary feeder lines 3$a$–3$i$ and the first primary feeder line portion 4$a$ on one side (left side as illustrated) of the reference line as well as a pattern of electrodes and conductor lines forming the antenna elements 2$j$–2$t$, the secondary feeder lines 3$j$–3$t$ and the second primary feeder line portion 4$b$ on the other side (right side as illustrated) of the reference line.

The phase-inverting distributor 6 distributes a signal fed through the outgoing line 5 to the first primary feeder line portion 4$a$ and the second primary feeder line portion 4$b$ with small loss with the signal transmitted to one of the primary feeder line portions 4$a$, 4$b$ inverted in phase. Specifically, the phase of the signal transmitted to the second primary feeder line portion 4$b$ is advanced or delayed by $\pi$ radians with respect to the phase of the signal transmitted to the first primary feeder line portion 4$a$, for example.

Figure 2:
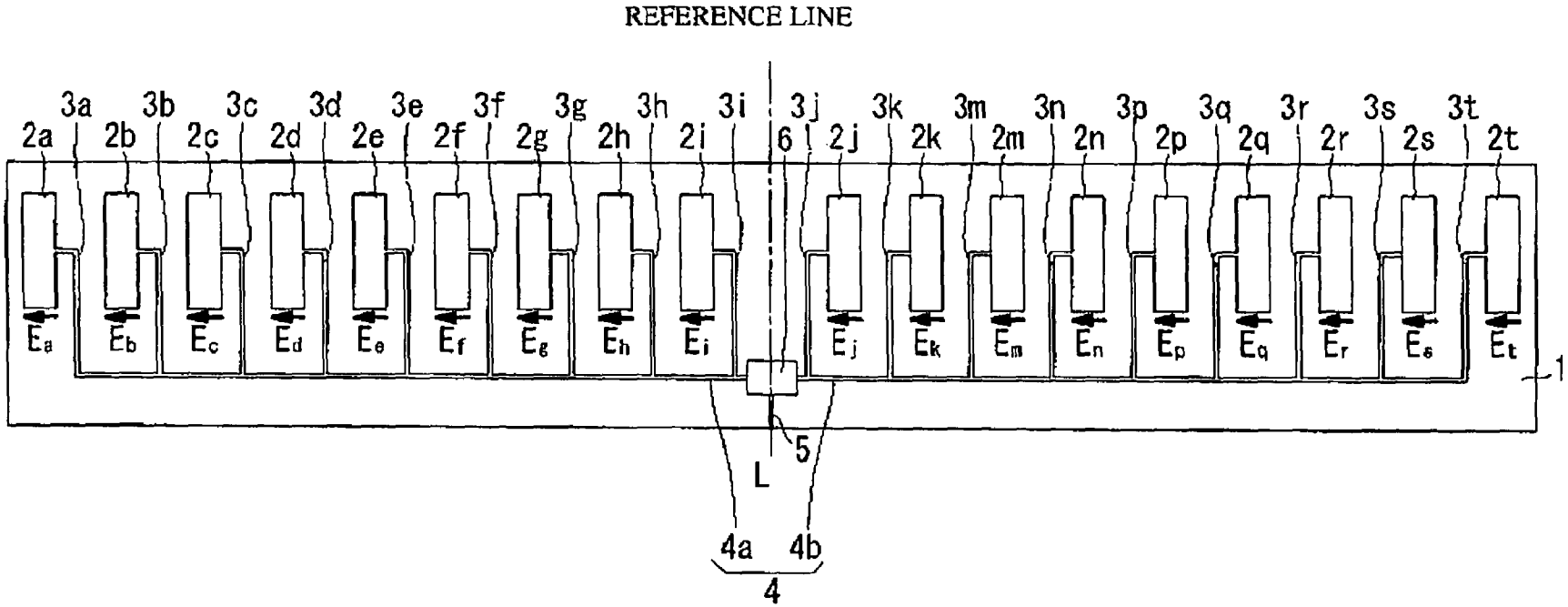
FIG. 2 is a conceptual diagram showing in which direction electric fields produced by individual antenna elements are oriented.

FIG. 2 is a conceptual diagram showing in which direction electric fields Ea-Et produced by the individual antenna elements 2$a$–2$t$ are oriented. Since the phase-inverting distributor 6 distributes the input signal to the first primary feeder line portion 4$a$ and the second primary feeder line portion 4$b$ in the aforementioned manner, the electric fields Ea–Et produced by the individual antenna elements 2$a$–2$t$ align in the same direction as illustrated.

Consequently, radio waves emitted from the antenna elements 2$a$–2$i$ and the antenna elements 2$j$–2$t$ which are symmetrically arranged on opposite sides of the reference line passing at right angles to the arraying direction of the antenna elements 2$a$–2$t$ (FIG. 1) are not canceled out one another and, thus, the array antenna radiates radio waves having desired directivity.

Here, the successive antenna elements 2$a$–2$t$ are arranged at intervals (element-to-element distances) shown in FIG. 1. Specifically, the interval between the antenna elements 2$a$ and 2$b$ is $L_{ab}$, the interval between the antenna elements 2$b$ and 2$c$ is $L_{bc}$, the interval between the antenna elements 2$c$ and 2$d$ is $L_{cd}$, the interval between the antenna elements 2$d$ and 2$e$ is $L_{de}$, the interval between the antenna elements 2$e$ and 2$f$ is $L_{ef}$, the interval between the antenna elements 2$f$ and 2$g$ is $L_{fg}$, the interval between the antenna elements 2$g$ and 2$h$ is $L_{gh}$, the interval between the antenna elements 2$h$ and 2$i$ is $L_{hi}$, the interval between the antenna elements 2$i$ and 2$j$ is $L_{ij}$, the interval between the antenna elements 2$j$ and 2$k$ is $L_{jk}$, the interval between the antenna elements 2$k$ and 2$m$ is $L_{km}$, the interval between the antenna elements 2$m$ and 2$n$ is $L_{mn}$, the interval between the antenna elements 2$n$ and 2$p$ is $L_{np}$, the interval between the antenna elements 2$p$ and 2$q$ is $L_{pq}$, the interval between the antenna elements 2$q$ and 2$r$ is $L_{qr}$, the interval between the antenna elements 2$r$ and 2$s$ is $L_{rs}$, the interval between the antenna elements 2$s$ and 2$t$ is $L_{st}$. In this embodiment, only the interval $L_{ij}$ between the antenna elements 2$i$ and 2$j$ differs from the other intervals $L_{ab}$–$L_{hi}$, $L_{jk}$–$L_{st}$ as shown in Table 1. These element-to-element intervals are set such that the radio waves emitted from all of the antenna elements 2$a$–2$t$ create a specific radiation pattern.

On the other hand, the secondary feeder lines 3$a$–3$t$ have varying impedances so that the individual secondary feeder lines 3$a$–3$t$ have predetermined amounts of attenuation as shown in Table 2. To achieve this, the secondary feeder lines 3$a$–3$t$ are formed of conductor lines having specific thicknesses and widths, or impedance elements, such as resistors, are series-connected midway in the secondary feeder lines 3$a$–3$t$ as appropriate.

Table 1 shows set values of the aforementioned element-to-element intervals $L_{ab}$–$L_{st}$, and Table 2 shows the amounts of attenuation from the phase-inverting distributor 6 to the individual antenna elements 2$a$–2$t$ including attenuation in the primary feeder line 4 and the respective secondary feeder lines 3$a$–3$t$.

TABLE 1

| Symbol | Element-to-element interval (mm) |
|---|---|
| Lab | 21.65 |
| Lbc | 21.65 |
| Lcd | 21.65 |
| Lde | 21.65 |
| Lef | 21.65 |
| Lfg | 21.65 |
| Lgh | 21.65 |
| Lhi | 21.65 |
| Lij | 25.65 |
| Ljk | 21.65 |
| Lkm | 21.65 |
| Lmn | 21.65 |
| Lnp | 21.65 |
| Lpq | 21.65 |
| Lqr | 21.65 |
| Lrs | 21.65 |
| Lst | 21.65 |

TABLE 2

| Antenna element | Amount of attenuation (dB) |
|---|---|
| 2a | −10.48 |
| 2b | −10.72 |
| 2c | −7.71 |
| 2d | −5.34 |
| 2e | −3.48 |
| 2f | −2.05 |
| 2g | −1.01 |
| 2h | −0.33 |
| 2i | 0.00 |
| 2j | 0.00 |
| 2k | −0.33 |
| 2m | −1.01 |
| 2n | −2.05 |
| 2p | −3.48 |
| 2q | −5.34 |
| 3r | −7.71 |
| 2s | −10.72 |
| 2t | −10.48 |

As shown in Table 1, only the interval $L_{ij}$ between the antenna elements 2$i$ and 2$j$ differs from the other element-to-element intervals $L_{ab}$–$L_{hi}$, $L_{jk}$–$L_{st}$ in the array antenna of this embodiment.

Also, as shown in Table 2, conductor lines (including portions of the primary feeder line and the secondary feeder lines) connected to any two antenna elements located at symmetrical positions with respect to the aforementioned reference line have the same amount of attenuation, and the amounts of attenuation in these conductor lines increase with the distance from the phase-inverting distributor 6 to each successive antenna element in the array antenna of this embodiment.

Figure 3:
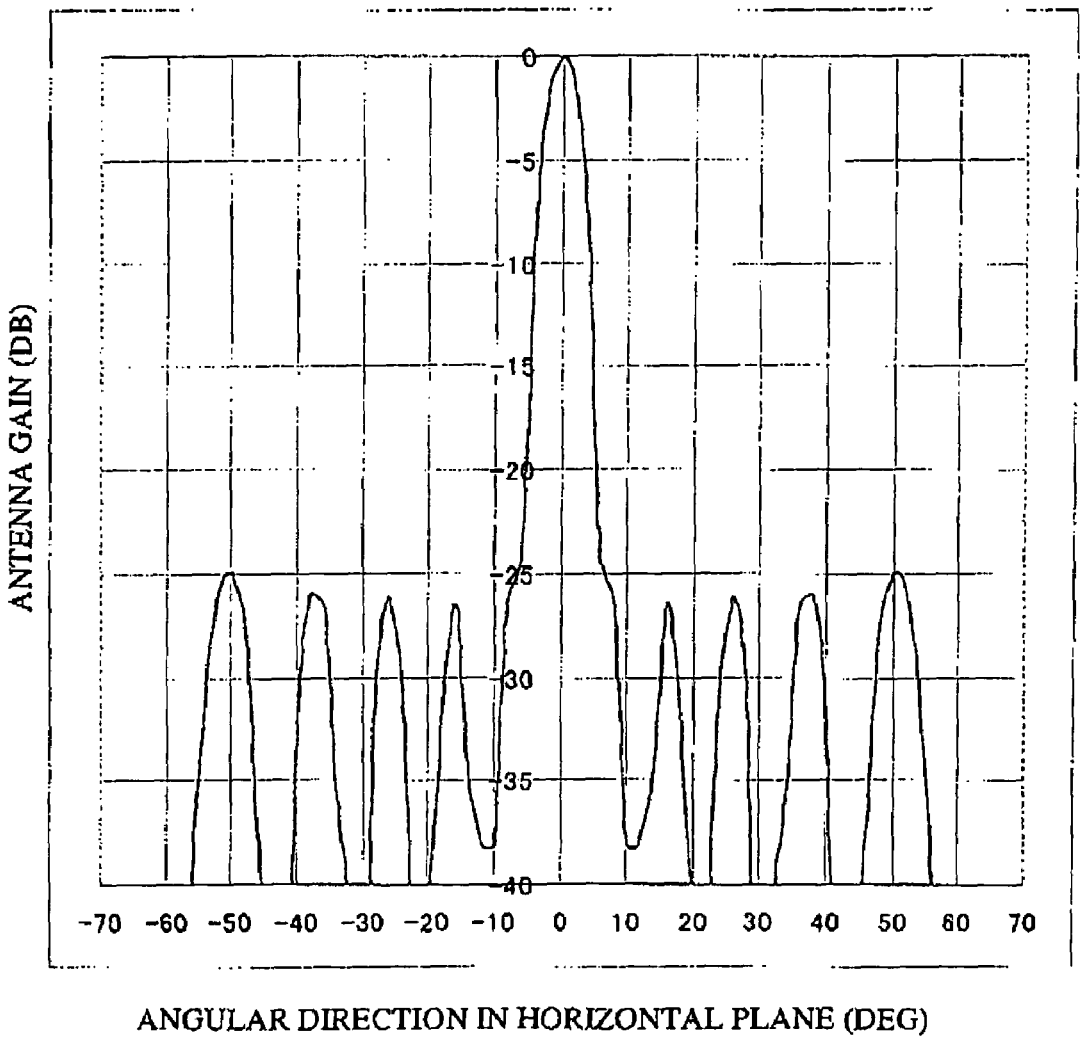
FIG. 3 is a diagram showing a horizontal radiation pattern formed by the array antenna of the first embodiment.

FIG. 3 is a diagram showing a horizontal radiation pattern formed by the array antenna of the first embodiment. The array antenna configured as explained above exhibits horizontal radiation characteristics as depicted in FIG. 3.

As thus far discussed, only the interval $L_{ij}$ between the antenna elements 2*i* and 2*j* closest to the phase-inverting distributor 6 is made different from the other element-to-element intervals $L_{ab}$–$L_{hi}$, $L_{jk}$–$L_{st}$ and the amounts of attenuation in the conductor lines from the phase-inverting distributor 6 to the individual antenna elements 2*a*–2*t* are set to predetermined values in the array antenna of the first embodiment. According to this arrangement of the embodiment, it is possible to produce an array antenna having sharp directivity with a simple configuration, in which a large proportion of radio wave energy is radiated in approximately a central direction in a horizontal plane, perpendicular to a radiating surface of the array antenna, as shown in FIG. 3.

As shown in FIG. 1, the substrate 1 has an overall length $L_{pwb}$ and the array antenna has a substantial antenna length $L_{ant}$. In the above-described configuration of the array antenna of the embodiment, the antenna elements 2*a*–2*t* are formed all the way from the proximity of one end of the substrate 1 to the proximity of the other end of the substrate 1 along the longitudinal direction thereof, so that the antenna elements 2*a*–2*t* can be arranged on the substrate 1 in an efficient fashion and the substantial antenna length $L_{ant}$ can be made as large as possible relative to the overall length $L_{pwb}$ of the substrate 1.

Furthermore, it is possible to obtain desired radiation characteristics by properly setting the amounts of attenuation for the individual secondary feeder lines 3*a*–3*t*. This means that an array antenna having the desired radiation characteristics (directivity) can be produced in an efficient way by using the substrate 1 having a given shape. Additionally, as the interval $L_{ij}$ between the antenna elements 2*i* and 2*j* at a central position of the substrate 1 along the arraying direction of the antenna elements 2*a*–2*t*, or the interval $L_{ij}$ between the antenna elements 2*i* and 2*j* closest to the phase-inverting distributor 6, is made different from the other element-to-element intervals $L_{ab}$–$L_{hi}$, $L_{jk}$–$L_{st}$, the array antenna is obtained with a simplified antenna element arrangement pattern.

An array antenna according to a second embodiment of the invention is now described with reference to FIG. 4 and Tables 3 and 4.

The array antenna of the second embodiment has basically the same configuration as the array antenna of the first embodiment (refer to FIG. 1) except that the intervals between the successive antenna elements 2*a*–2*t* and the amounts of attenuation in the individual antenna elements 2*a*–2*t* in the array antenna of the second embodiment are varied from those of the first embodiment.

Table 1 shows the intervals $L_{ab}$-$L_{st}$ between the successive antenna elements 2*a*–2*t*, and Table 2 shows the amounts of attenuation from the phase-inverting distributor 6 to the individual antenna elements 2*a*–2*t* including attenuation in the primary feeder line 4 and the respective secondary feeder lines 3*a*–3*t*.

TABLE 3

| Symbol | Element-to-element interval (mm) |
|---|---|
| Lab | 25.65 |
| Lbc | 23.40 |
| Lcd | 21.90 |
| Lde | 21.65 |
| Lef | 21.75 |
| Lfg | 21.65 |
| Lgh | 22.15 |
| Lhi | 23.50 |
| Lij | 25.65 |
| Ljk | 23.50 |
| Lkm | 22.15 |
| Lmn | 21.65 |
| Lnp | 21.75 |
| Lpq | 21.65 |
| Lqr | 21.90 |
| Lrs | 23.40 |
| Lst | 25.65 |

TABLE 4

| Antenna element | Amount of attenuation (dB) |
|---|---|
| 2a | −13.58 |
| 2b | −9.88 |
| 2c | −7.81 |
| 2d | −6.52 |
| 2e | −3.72 |
| 2f | −2.67 |
| 2g | −2.19 |
| 2h | −0.61 |
| 2i | 0.00 |
| 2j | 0.00 |
| 2k | −0.61 |
| 2m | −2.19 |
| 2n | −2.67 |
| 2p | −3.72 |
| 2q | −6.52 |
| 3r | −7.81 |
| 2s | −9.88 |
| 2t | −13.58 |

As shown in Table 3, the interval Lab between the antenna elements 2*a* and 2*b* is equal to the interval $L_{st}$ between the antenna elements 2*s* and 2*t* ($L_{ab}$=$L_{st}$), the interval $L_{bc}$ between the antenna elements 2*b* and 2*c* is equal to the interval $L_{rs}$ between the antenna elements 2*r* and 2*s* ($L_{bc}$=$L_{rs}$), the interval $L_{cd}$ between the antenna elements 2*c* and 2*d* is equal to the interval $L_{qr}$ between the antenna elements 2*q* and 2*r* ($L_{cd}$=$L_{qr}$), the interval $L_{de}$ between the antenna elements 2*d* and 2*e* is equal to the interval $L_{pq}$ between the antenna elements 2*p* and 2*q* ($L_{pq}$=$L_{pq}$), the interval $L_{ef}$ between the antenna elements 2*e* and 2*f* is equal to the interval $L_{np}$ between the antenna elements 2*n* and 2*p* ($L_{ef}$=$L_{np}$), the interval $L_{fg}$ between the antenna elements 2*f* and 2*g* is equal to the interval $L_{mn}$ between the antenna elements 2*m* and 2*n* ($L_{fg}$=$L_{mn}$), the interval $L_{gh}$ between the antenna elements 2*g* and 2*h* is equal to the interval $L_{km}$ between the antenna elements 2*k* and 2*m* ($L_{gh}$=$L_{km}$), and the interval $L_{hi}$ between the antenna elements 2*h* and 2*i* is equal to the interval $L_{jk}$ between the antenna elements 2*j* and 2*k* ($L_{hi}$=$L_{jk}$). While the element-to-element intervals at any two symmetrical points with respect to the reference line passing through the phase-inverting distributor 6 are equal to each other as stated above, the interval $L_{ij}$ between the antenna elements 2*i* and 2*j* and the aforementioned element-to-element intervals on each side of the reference line are not necessarily equal to one another but are made unequal in this embodiment as indicated in Table 3.

Also, as shown in Table 4, conductor lines (including portions of the primary feeder line and the secondary feeder lines) connected to any two antenna elements located at symmetrical positions with respect to the aforementioned reference line have the same amount of attenuation, and the amounts of attenuation in these conductor lines increase with the distance from the phase-inverting distributor 6 to each successive antenna element in the array antenna of this embodiment.

Figure 4:
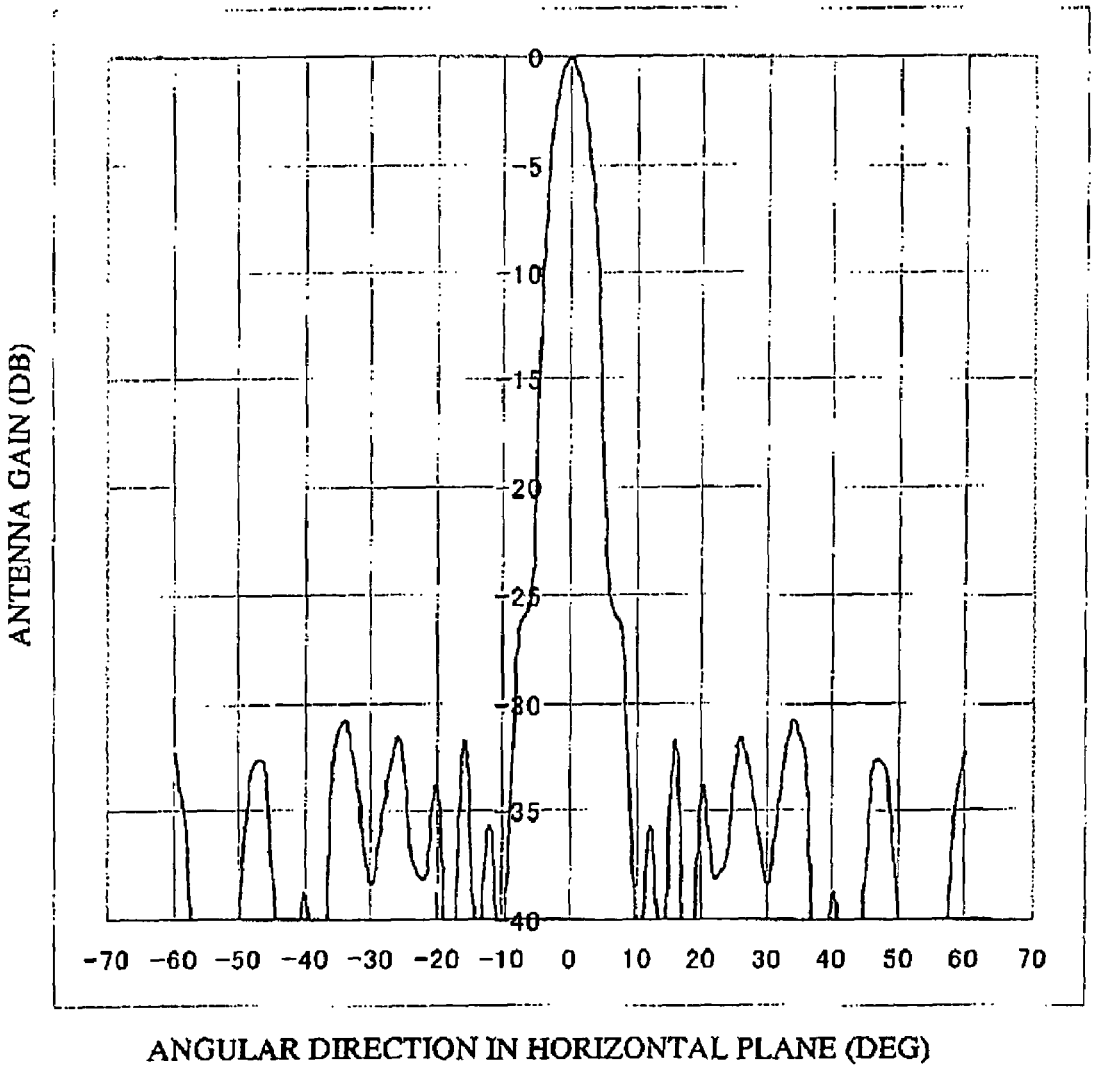
FIG. 4 is a diagram showing a horizontal radiation pattern formed by an array antenna of a second embodiment.

FIG. 4 is a diagram showing a horizontal radiation pattern formed by the array antenna of the second embodiment. The array antenna configured as explained above exhibits horizontal radiation characteristics as depicted in FIG. 4.

With the aforementioned configuration of the second embodiment, it is possible to produce an array antenna having much sharper directivity (FIG. 4) than shown in FIG. 3. As can be seen from a comparison between the radiation patterns of FIGS. 3 and 4, a significantly larger proportion of radio wave energy is radiated in approximately the central direction in the horizontal plane, perpendicular to the radiating surface of the array antenna, in the second embodiment than in the first embodiment.

The configuration of the second embodiment makes it possible to properly set the element-to-element intervals as well as the amounts of attenuation for the individual secondary feeder lines 3*a*–3*t*, so that a desired radiation pattern can be obtained from a wider range of radiation characteristics. In other words, an array antenna having the desired radiation characteristics (directivity) can be produced in an efficient way by setting the radiation characteristics within a wider range using the substrate 1 having a given shape. Furthermore, since the antenna elements 2*a*–2*t* can be arranged with more degrees of freedom in the second embodiment than in the first embodiment, it is possible to produce an array antenna having more optimized radiation characteristics.

Figure 5:
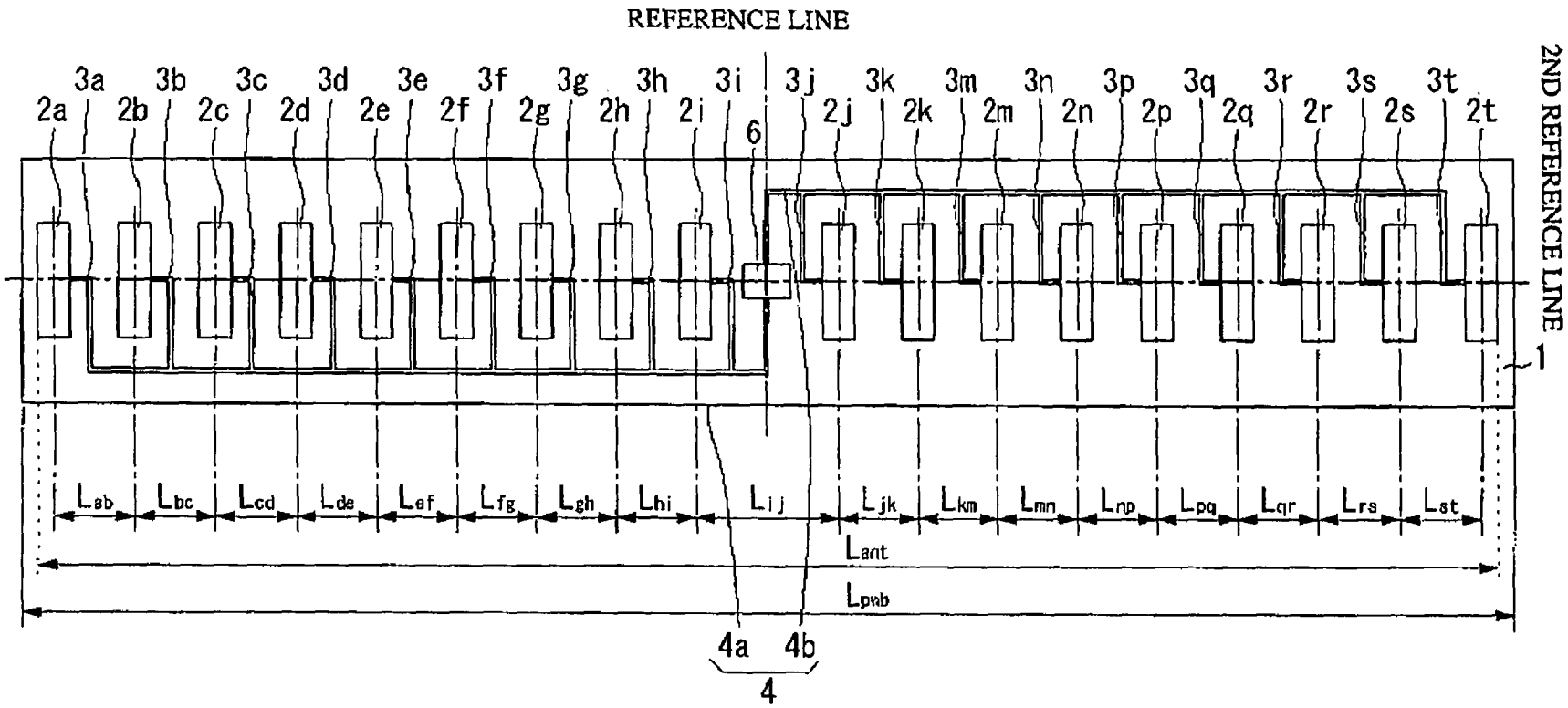
FIG. 5 is a plan view generally showing the configuration of an array antenna according to a third embodiment of the invention.
Figure 6:
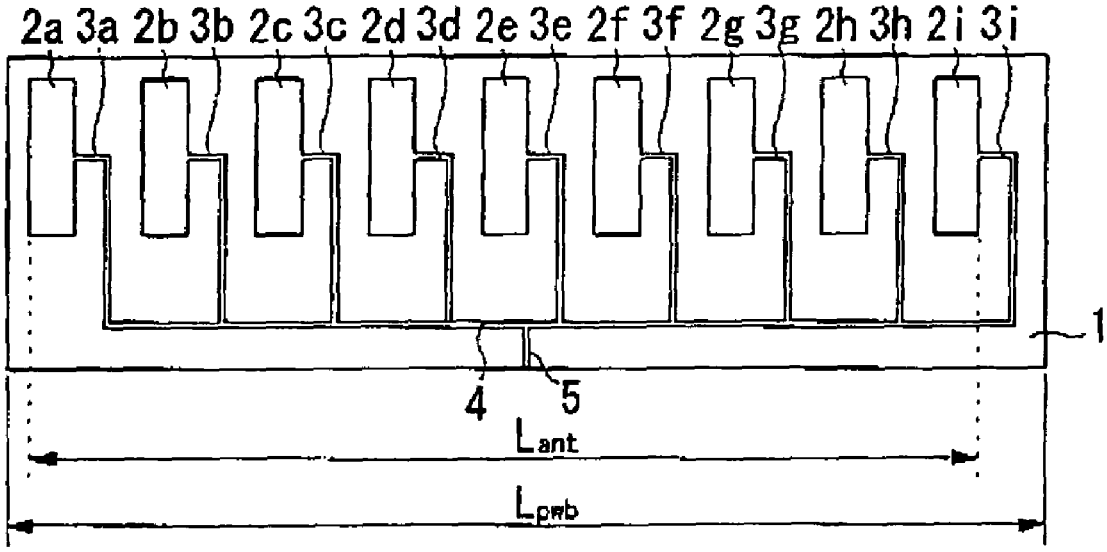
FIG. 6 is a plan view generally showing the configuration of a conventional array antenna.

FIG. 5 is a plan view generally showing the configuration of an array antenna according to a third embodiment of the invention. While the antenna elements 2*a*–2*i* and 2*j*–2*t*, the primary feeder line portions 4*a* and 4*b*, and the secondary feeder lines 3*a*–3*i* and 3*j*–3*t* are symmetrically arranged with respect to the reference line which passes through the phase-inverting distributor 6 at right angles to the arraying direction of the antenna elements 2*a*–2*t* in the foregoing first and second embodiments, this arrangement may be modified as shown in FIG. 5. Specifically, in the array antenna of the third embodiment, the phase-inverting distributor 6 is located at a point of intersection of the aforementioned reference line and a second reference line passing through midpoints of the long sides of the antenna elements 2*a*–2*t* which are parallel to the reference line, and the primary feeder line portions 4*a*, 4*b* and the secondary feeder lines 3*a*–3*i*, 3*j*–3*t* are symmetrically arranged with respect to the point of intersection of the reference line and the second reference line (point symmetry) as illustrated in FIG. 5. The array antenna thus configured exhibits the same advantageous effects as discussed above with reference to the first and second embodiments.

While the array antennas of the foregoing embodiments are provided with 18 antenna elements each, the embodiments may be modified such that the array antenna is provided with any desired number of antenna elements according to required radiation characteristics and technical specifications of an apparatus for which the array antenna is used.

Furthermore, although the phase-inverting distributor 6 is formed in the area located generally on the reference line (vertical centerline) passing through a midpoint along the arraying direction of the antenna elements 2*a*–2*t* in the foregoing embodiments, the phase-inverting distributor 6 may be formed in any area selected along the arraying direction of the antenna elements 2*a*–2*t* according to required radiation characteristics.

Moreover, while the impedances of the secondary feeder lines 3*a*–3*t* are individually set such that the impedance of the conductor line from the phase-inverting distributor 6 to each of the antenna elements 2*a*–2*t* varies in a desired fashion in the foregoing embodiments, the impedance of the conductor line from the phase-inverting distributor 6 to each of the antenna elements 2*a*–2*t* may be varied by setting the impedance of a length of the primary feeder line 4 from the phase-inverting distributor 6 to a connecting point between the primary feeder line 4 and each of the secondary feeder lines 3*a*–3*t* to a desired value.

What is claimed is:

1. An array antenna comprising:

a substrate;

a plurality of antenna elements formed on a surface of the substrate in such a way that the antenna elements are arranged generally in a straight line;

a plurality of secondary feeder lines individually connected to the antenna elements on sides thereof which are perpendicular to an arraying direction of the antenna elements;

a primary feeder line to which the individual secondary feeder lines are connected parallel to one another; and a phase-inverting distributor inserted in the primary feeder line in an area located halfway along the length of the primary feeder line;

wherein the sides of the antenna elements connected to the individual secondary feeder lines face a reference line which passes through the phase-inverting distributor perpendicular to the arraying direction of the antenna elements; and wherein the antenna elements are symmetrically arranged with respect to said reference line, and at least one of element-to-element intervals differs from the others.

2. The array antenna according to claim 1, wherein the primary feeder line and the secondary feeder lines are symmetrically arranged with respect to said reference line.

3. The array antenna according to claim 1, wherein the phase-inverting distributor is located at a point of intersection of said reference line and a second reference line passing through midpoints of the sides of the antenna elements which are parallel to said reference line, said second reference line being perpendicular to said reference line, and the primary feeder line and the secondary feeder lines are symmetrically arranged with respect to the point of intersection of said reference line and said second reference line.

4. The array antenna according to one of claims 1 to 3, wherein conductor lines from the phase-inverting distributor to the individual antenna elements have varying impedances on each side of said reference line, each of the conductor lines including a portion of the primary feeder line and one of the secondary feeder lines.

5. The array antenna according to one of claims 1 to 3, wherein the interval between only those two antenna elements which are closest to the phase-inverting distributor differs from the interval between any two adjacent antenna elements.

6. The array antenna according to claim 4, wherein the interval between only those two antenna elements which are closest to the phase-inverting distributor differs from the interval between any two adjacent antenna elements.

* * * * *